US010213804B2

(12) United States Patent
Bolyard, Jr.

(10) Patent No.: US 10,213,804 B2
(45) Date of Patent: Feb. 26, 2019

(54) FLUID APPLICATION DEVICE HAVING A MODULAR CONTACT NOZZLE WITH A FLUIDIC OSCILLATOR

(71) Applicant: Illinois Tool Works Inc., Glenview, IL (US)

(72) Inventor: Edward Wayne Bolyard, Jr., Old Hickory, TN (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 15/647,837

(22) Filed: Jul. 12, 2017

(65) Prior Publication Data

US 2017/0304863 A1 Oct. 26, 2017

Related U.S. Application Data

(63) Continuation of application No. 14/539,517, filed on Nov. 12, 2014, now Pat. No. 9,718,084.
(Continued)

(51) Int. Cl.

| | |
|---|---|
| ***B05C 5/00*** | (2006.01) |
| ***B05C 5/02*** | (2006.01) |
| ***B05C 9/06*** | (2006.01) |
| ***B05B 1/08*** | (2006.01) |
| *B05C 9/00* | (2006.01) |

(52) U.S. Cl.
CPC ..... *B05C 5/025* (2013.01); *B05B 1/08* (2013.01); *B05C 5/0241* (2013.01);
(Continued)

(58) Field of Classification Search
USPC ..... 118/300, 325, 500; 239/548, 549, 600, 239/601
See application file for complete search history.

(56) References Cited

U.S. PATENT DOCUMENTS 2,770,940 A 11/1956 Morrison et al.
4,773,764 A 9/1988 Colombani et al.
(Continued)

FOREIGN PATENT DOCUMENTS

CN 1269736 A 10/2000
CN 1283135 A 2/2001
(Continued)

*Primary Examiner* — Yewebdar T Tadesse
(74) *Attorney, Agent, or Firm* — Levenfeld Pearlstein, LLC

(57) ABSTRACT

A fluid application device having a contact nozzle assembly with a fluidic oscillator is provided. The fluid application device includes an applicator head and a nozzle assembly. The nozzle assembly includes a first conduit configured to receive a first fluid from the applicator head, a second conduit configured to receive a second fluid from the applicator head and an application conduit including a receptacle and first and second branches. The receptacle is fluidically connected with the first conduit and configured to receive the first fluid. The first and second branches are fluidically connected to the second conduit and receptacle and are configured to receive the second fluid. The nozzle assembly further includes an orifice fluidically connected to the application conduit and configured to discharge the first fluid for application onto a strand of material, and a guide slot extending from the orifice and configured to receive the strand of material.

7 Claims, 8 Drawing Sheets

Related U.S. Application Data

(60) Provisional application No. 61/929,744, filed on Jan. 21, 2014.

(52) U.S. Cl.
CPC ..... *B05C 5/0245* (2013.01); *B05C 9/06* (2013.01); *B05C 5/027* (2013.01); *B05C 9/00* (2013.01)

(56) References Cited

U.S. PATENT DOCUMENTS

| | | | | |
|---|---|---|---|---|
| 5,192,591 | A | 3/1993 | Chance | |
| 5,389,151 | A * | 2/1995 | Fort | B05C 5/027 118/411 |
| 7,152,815 | B2 | 12/2006 | Harris et al. | |
| 2003/0173024 | A1 | 9/2003 | Hayder et al. | |
| 2005/0013940 | A1 | 1/2005 | Lessley et al. | |
| 2007/0145164 | A1 | 6/2007 | Ahmadl et al. | |
| 2011/0271903 | A1 | 11/2011 | Durst et al. | |
| 2012/0219657 | A1* | 8/2012 | Kondo | B05C 5/0254 425/382 R |
| 2012/0258246 | A1 | 10/2012 | Saine et al. | |
| 2012/0258277 | A1 | 10/2012 | Ukegawa | |

FOREIGN PATENT DOCUMENTS

| | | | |
|---|---|---|---|
| CN | 1674999 | A | 9/2005 |
| CN | 1826181 | A | 8/2006 |
| CN | 1933912 | A | 3/2007 |

* cited by examiner

FLUID APPLICATION DEVICE HAVING A MODULAR CONTACT NOZZLE WITH A FLUIDIC OSCILLATOR

This application is a continuation of U.S. patent application Ser. No. 14/539,517, filed Nov. 12, 2014, which claims the benefit of and priority to Provisional Patent Application Ser. No. 61/929,744, filed Jan. 21, 2014, the disclosures of which are incorporated herein in their entireties.

BACKGROUND

The following description relates to a fluid application device for applying a fluid onto a strand of material, and in particular, a fluid application device having a modular contact nozzle with a fluidic oscillator so as to apply the fluid onto the strand of material in a non-linear pattern.

Nonwoven fabrics are engineering fabrics that provide specific functions such as absorbency, liquid repellence, resilience, stretch, softness, strength, flame retardant protection, easy cleaning, cushioning, filtering, use as a bacterial barrier and sterility. In combination with other materials, nonwoven materials can provide a spectrum of products with diverse properties and can be used alone or as components of hygiene apparel, home furnishings, health care, engineering, industrial and consumer goods.

A plurality of elasticated strands may be positioned on and bonded to the nonwoven materials to, for example, allow for flexibility fitting around an object or a person. The strands may be bonded to the nonwoven fabric with an adhesive, such as glue. In one configuration, the strands are fed past a nozzle on an adhesive application device. The nozzle may include a plurality of outlets through which the glue may be discharged. A second fluid, such as air, may be discharged through separate outlets to control the application of the glue such that the glue is oscillated across the respective strands as the strands pass by the nozzle. In such a configuration, the glue may be discharged as a fiber, and the fiber is oscillated by the air.

An adhesive application device may apply the glue to the strands with either a contact nozzle or a non-contact nozzle. A contact nozzle discharges a volume of substantially stationary glue while a substrate, such as the strand, is fed by the glue. The strand is in contact with the glue and the glue adheres to the strand as a result of the contact. In a non-contact nozzle, the glue may be discharged from an outlet as a fiber. The glue fiber is discharged over a gap between the outlet and the strand, and is ultimately received on the strand. Discharging of the glue fiber may be controlled by a second fluid, such as air, discharged from adjacent outlets, to oscillate the glue fiber during application onto the strand.

A non-contact nozzle may be beneficial for applying the glue fiber on the strand in a desired pattern, for example, in a substantially sinusoidal pattern. However, a line speed, i.e., a speed at which the strand is fed past the nozzle, typically cannot exceed about 400 meters per minute (mpm) to achieve the desired pattern using a non-contact nozzle. A higher line speed may be achieved with a contact nozzle. However, a contact nozzle is limited to applying the glue onto the strand in a substantially linear pattern.

Accordingly, it is desirable to provide a fluid application device having a contact nozzle configured to apply the fluid onto the strand in a non-linear pattern such that the fluid may be applied over a wider area of the strands.

SUMMARY

According to one embodiment, there is provided a fluid application device having an applicator head and a nozzle assembly fluidically coupled to, i.e., in fluid communication with, the applicator head. The nozzle assembly includes a first conduit configured to receive a first fluid from the applicator head, a second conduit configured to receive a second fluid from the applicator head and an application conduit including a receptacle, a first branch and a second branch. The receptacle is fluidically connected with the first conduit and is configured to receive the first fluid, and the first branch and the second branch are fluidically connected to the second conduit and the receptacle and are configured to receive the second fluid. The nozzle assembly further includes an orifice fluidically connected to the application conduit. The orifice is configured to discharge the first fluid for application onto a strand of material. A guide slot extends relative the orifice and is configured to receive the strand of material.

According to another embodiment there is provided a fluid application device including an applicator head and a nozzle assembly fluidically coupled to the applicator head. The nozzle assembly includes a first conduit configured to receive a first fluid from the applicator head and an application conduit including a first branch and a second branch fluidically connected with the first conduit and configured to receive the first fluid. The nozzle assembly further includes an orifice fluidically connected to the application conduit, and configured to discharge the first fluid for application onto a strand of material, and a guide slot extending relative to the orifice, the guide slot configured to receive the strand of material.

According to yet another embodiment, there is provided a nozzle assembly for a fluid application device. The nozzle assembly includes a first conduit configured to receive a first fluid, a second conduit configured to receive a second fluid and an application conduit including a receptacle, a first branch and a second branch. The receptacle is fluidically connected with the first conduit and is configured to receive the first fluid and the first branch and the second branch are fluidically connected between the second conduit and the receptacle and are configured to receive the second fluid. The nozzle assembly further includes an orifice fluidically connected to the application conduit. The orifice is configured to discharge the first fluid for application onto a strand of material. A guide slot extends relative to the orifice and is configured to receive the strand of material.

According to still another embodiment, there is provided a nozzle assembly for a fluid application device. The nozzle assembly includes a first conduit configured to receive a first fluid from the applicator head and an application conduit including a first branch and a second branch fluidically connected with the first conduit and configured to receive the first fluid. The nozzle assembly further includes an orifice fluidically connected to the application conduit and configured to discharge the first fluid for application onto a strand of material, and a guide slot extending relative to the orifice, the guide slot configured to receive the strand of material.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
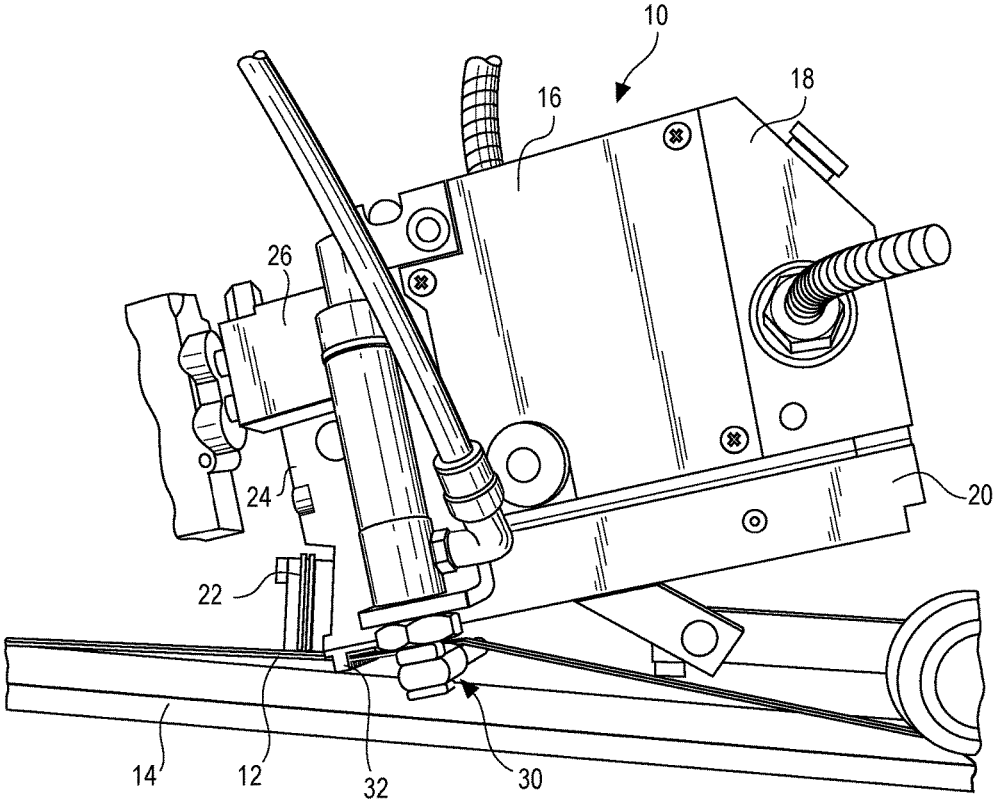
FIG. 1 is a perspective view of a fluid application device having a contact nozzle assembly according to an embodiment described herein.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1 is a side perspective view of a fluid application device 10 according to an embodiment described herein. The fluid application device 10 may be used to apply a first fluid onto an article. For example, the fluid application device 10 may apply a first fluid onto an article. The first fluid may be a viscous fluid that is a liquefied material heated or non-heated between about 10 and 50,000 centipoise (cps). The first fluid may be, for example, an adhesive, and the article may be, for example, an elastic or non-elastic strand 12 of material. That is, in one embodiment, the fluid application device 10 is part of a strand coating system. The adhesive may be applied to the strand 12 so that the strand 12 may be adhered to a substrate 14, such as a nonwoven material. The strand 12, in one embodiment, may be made from an elastic material and may be in either a stretched condition or a relaxed condition as the first fluid is applied. The strand 12 of material may be, for example, spandex, rubber or other similar elastic material.

According to one embodiment, the fluid application device 10 includes an applicator head 16. The applicator head 16 may include a first fluid supply unit 18 and a second fluid supply unit 20. The fluid application device 10 also includes a nozzle assembly 22 fluidically coupled to the applicator head 16. The first fluid supply unit 18 is configured to receive the first fluid F1 from a first fluid source (not shown) and the second fluid supply unit 20 is configured to receive a second fluid F2 from a second fluid source (not shown). The nozzle assembly 22 is fluidically coupled to, i.e., is in fluid communication with, the first fluid supply unit 18. The nozzle assembly 22 may also be fluidically coupled to, i.e., may be in fluid communication with, the second fluid supply unit 20. Accordingly, the nozzle assembly 22 may receive the first fluid F1 from the first fluid supply unit 18 and the second fluid F2 from the second fluid supply unit 20.

In some embodiments, the applicator head 16 may also include an adapter 24 secured to at least one of the first fluid supply unit 18 and second fluid supply unit 20. The adapter 24 is positioned adjacent to the nozzle assembly 22 and is fluidically coupled to, i.e., is in fluid communication with, the nozzle assembly 22. In addition, the adapter 24 is fluidically coupled to one of or both of the first fluid supply unit 18 and second fluid supply unit 20, such that the nozzle assembly 22 may receive the first fluid and the second fluid via the adapter 24. That is, the adapter 24 is in fluid communication with at least one of the first fluid supply unit 18 and the second fluid supply unit 20 and also the nozzle assembly 22. The adapter 24 is configured to have the nozzle assembly 22 secured thereto such that the nozzle assembly 22 may be properly positioned and oriented relative the applicator head 16 and/or a path along which the strands 12 travel.

The applicator head 16 may also include a flow control module 26. The flow control module 26 may include a valve or series of valves to regulate a flow of the first fluid and second fluid from the first fluid supply unit 18 and second fluid supply unit 20, respectively, to the nozzle assembly 22. The flow control module 26 and the adapter 24 may be integrated such that the adapter 24 and the flow control module 26 are one and the same. That is, in some embodiments, the adapter 24 and flow control module 26 are implemented as the same unit. This unit provides an adhesive path between one of or both of the first and second fluid supply units 18, 20 and the nozzle assembly 22. This unit, i.e., the combined adapter 24 and flow control module 26 may also include valving to start and stop the flow of adhesive.

Figure 2:
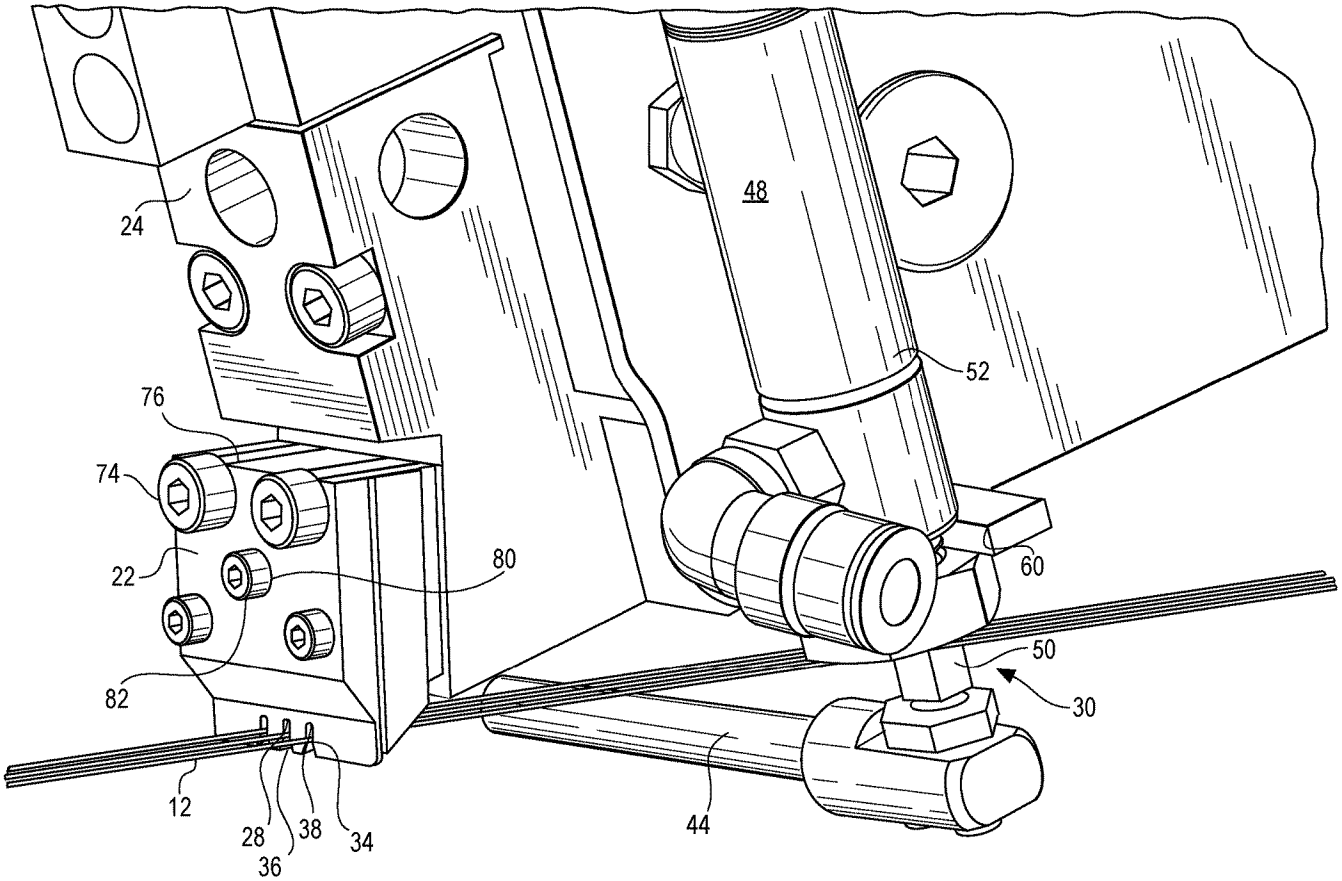
FIG. 2 is a front perspective view of the fluid application device of FIG. 1.

FIG. 2 is a front perspective view of the fluid application device 10 according to an exemplary embodiment. With reference to FIGS. 1 and 2, the nozzle assembly 22 may be removably secured to the adapter 24 or other adjacent component of the applicator head 16. The nozzle assembly 22 may be a contact nozzle assembly 22. The nozzle assembly 22 includes an orifice 28, through which the first fluid F1 (see FIG. 4) may be applied directly on the strand 12. There may be at least one orifice 28 associated with each strand 12 of material. In some embodiments, there is one orifice 28 associated with each strand 12. That is, each orifice 28 may discharge the first fluid directly to a respective strand 12. Each orifice 28 may have a width of approximately 0.016-0.020 inches (in.), but is not limited thereto. For example, the width of the orifices 28 may be varied to accommodate different sizes of strands 12. In addition, in an embodiment of the present contact nozzle assembly, the second fluid F2 (see FIG. 4) may also be discharged adjacent to or at the orifice 28 as described further below. The second fluid F2 may be used to control the application of the first fluid on the strand 12, for example, by moving the first fluid F1 back and forth across a width of, or at least partially around an outer circumference of, the strand 12 as the first fluid F1 is applied.

As noted above, the first fluid F1 may be an adhesive, such as a hot melt adhesive. The adhesive may be discharged from the orifice 28, for example, as a bead that is contacted directly by the strand 12. The applicator head 16 may be heated to either melt the first fluid or maintain the first fluid F1 in a melted condition. For example, the first fluid supply unit 18, the second fluid supply unit 20, and/or the nozzle assembly 22 may be heated, and thus, may also radiate heat outwardly. The applicator head 16 may also include a heater.

The second fluid F2 may be, for example, air, and may be used to control the discharge of the first fluid F1 at the orifice 28 of the nozzle assembly 22 and onto the strand 12 as described above. In a non-limiting example, there are two branches 174*a*, 174*b* (see FIGS. 3 and 4) configured to discharge the second fluid F2 adjacent to each orifice 28 that discharges the first fluid F1 as described further below. It is understood, however, that the number of branches 174*a*, 174*b* associated with each orifice 28 may vary. The second fluid may be alternately discharged from the outlets adjacent to each orifice 28 to cause the first fluid F1 to fluctuate and during application to the strand 12.

The fluid application device 10 further includes a strand engagement device 30. The strand engagement device 30 may be formed integrally with the applicator head 16. Alternatively, the strand engagement device 30 may be secured to the applicator head 16 or other component of the fluid application device 10 with a suitable fastener, including, but not limited to, bolts, screws, rivets, adhesives, welds and the like. The strand engagement device 30 is configured to engage the strands 12 and move the strands 12 toward or away from the applicator head 16 and nozzle assembly 22 based on a line condition (active or static) of the fluid application device 10, as described further below.

Referring to FIGS. 1 and 2, the contact nozzle assembly 22 further includes a depending guide section 32 to assist in positioning of the strands 12 relative to the orifices 28 and branches 174*a*, 174*b* (see FIGS. 3 and 4) of the nozzle assembly 22. The guide section 32 also includes at least one guide slot 34 through which the strand 12 may be fed. The guide slot 34 includes an open end 36 and a closed end 38. In one embodiment, the closed end 38 is positioned immediately adjacent to the orifice 28. The open end 36 may be formed in a substantially inverted v-shape, while the closed end 38 may be rounded or curved so that it substantially matches a profile of the strand 12. The guide slot 34 may have a substantially constant width between the open end 36 and closed end 38. The closed end 38 may act as a limit or stop for the strands 12 to position the strands 12 at the desired position relative the orifices 28 and branches 174*a*, 174*b* (see FIGS. 3 and 4) for application of the first fluid F1. In one embodiment, the strand 12 contacts the closed end 38. Alternatively, the strand 12 may be spaced from, but in close proximity to the closed end 38.

According to one embodiment, the at least one guide slot 34 may include three guide slots 34. However, it is understood that the number of guide slots 34 may vary, and is not limited to the example above. Each guide slot 34 is associated with a corresponding orifice 28 of the nozzle assembly 22. That is, each guide slot 34 is substantially aligned with a corresponding orifice 28 of the nozzle assembly 22. For example, the closed end 38 of respective guide slots 34 may be aligned with respective orifices 28.

With further reference to FIGS. 1 and 2, the strand engagement device 30 includes an engagement arm 44 configured to support and/or guide the strand or strands 12. The engagement arm 44 is adjustable to move the strands 12 within, or relative to, respective guide slots 34 to position the strands 12 relative to the respective orifices 28 and outlets.

FIG. 2 shows the engagement arm 44 in a first position. The engagement arm 44 is adjustable between a first position, as shown in FIG. 2, and a second position (not shown). The first position corresponds to a position where the engagement arm 44 is spaced a first distance from the applicator head 16. The first distance is sufficient to prevent or limit damage, such as burn through, to the strands 12 caused from heat radiating from the applicator head 16 and/or nozzle assembly 22. For example, the engagement arm 44, in the first position may space the strands 12 approximately 3-5 mm from a heat source of the applicator head 16. It may be desirable to maintain the engagement arm 44 in the first position when the fluid application device is in a static line condition, i.e., when the strands 12 are not being fed past respective orifices 28.

The second position (not shown) corresponds to a position where the engagement arm 44 is spaced a second distance, less than the first distance, from the applicator head 16, such that the strands 12 are moved closer to the applicator head 16 and the respective orifices 28. In one example, the second position of the engagement arm 44 positions the strands approximately at or partially within the orifices 28. That is, the second position of the engagement arm 44 generally corresponds to a position where the first fluid F1 may be applied directly on the strand 12. Moving the engagement arm 44 to, and maintaining the engagement arm in, the second position may be beneficial when the fluid application device 10 is in an active line condition, i.e., when the strands 12 are being fed past respective orifices 28, so that the first fluid F1 may be efficiently applied on the strands 12 and overspray may be reduced.

Referring still to FIGS. 1 and 2, the engagement arm 44 may be adjusted by an actuating assembly 48. The actuating assembly 48 may be, for example, a pneumatically controlled piston 50 and cylinder 52. For example, the piston 50 may be movable within the cylinder 52 in response to air or another gas being introduced into the cylinder 52. The piston 50 may be connected directly or indirectly to the engagement arm 44 such that movement of the piston 50 in and out of the cylinder 52 causes the engagement arm 44 to move toward or away from the applicator head 16.

Referring still to FIGS. 1 and 2, the nozzle assembly 22 may be formed as a modular unit. That is, the nozzle assembly 22 may be selectively removed from and secured to the fluid application device 10. For example, the nozzle assembly 22 may be selectively removed from and secured to the applicator head 16, and more specifically, in some embodiments, the adapter 24. Accordingly, the nozzle assembly 22 may be replaced in the event a new or different nozzle assembly is desired or required. The nozzle assembly 22 is selectively removable from and securable to the fluid application device 10 by way of at least one securing element 74 (FIG. 2). In one embodiment, the nozzle assembly 22 includes at least one securing opening 76 extending therethrough, each securing opening 76 configured to receive a respective securing element 74.

With further reference to FIGS. 1 and 2, the nozzle assembly 22 may include two securing openings 76, each configured to receive a respective securing element 74. It is understood that the number of securing openings 76 is not limited to the example above, however. Individual securing openings 76 may be formed as an opening or slot extending through the nozzle assembly 22. The opening or slot may be closed about its periphery or include an open side along an edge of the nozzle assembly 22. The securing elements 74 extend through the securing openings 76 and are received in corresponding bores (not shown) in the fluid application device 10 to secure the nozzle assembly 22 to the applicator head 16. This allows for a modular design of the fluid application device 10 and nozzle assembly 22 to facilitate maintenance, replacement or the like.

Figure 3:
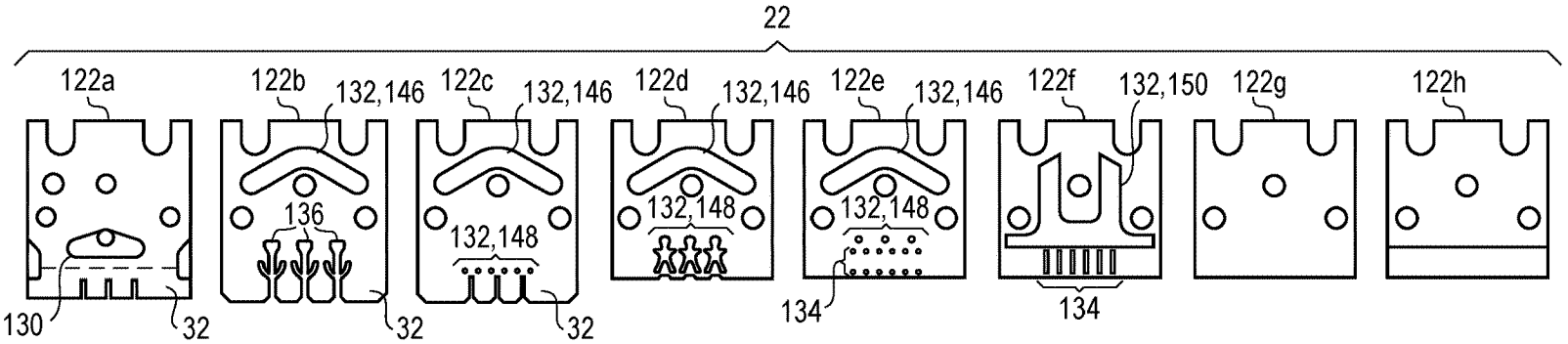
FIG. 3 is a plan view of contact nozzle components according to an embodiment described herein.

FIG. 3 is a plan view of contact nozzle assembly components according to an embodiment described. With reference to FIG. 3, the nozzle assembly 22 may be formed by a plurality of laminated or stacked plates 122*a-h*. In the example shown in FIG. 3, the nozzle assembly includes first plate 122*a*, second plate 122*b*, third plate 122*c*, fourth plate 122*d*, fifth plate 122*e*, sixth plate 122*f*, seventh plate 122*g* and eighth plate 122*h*. It is understood, however, that the number of plates 122 in the nozzle assembly 22 may vary and is not limited to the example shown in FIG. 3. FIGS. 4A-4H are enlarged views of the first through eighth plates, 122*a*-122*h*, respectively, shown in FIG. 3.

Referring to FIGS. 3, 4B, 4E and 4F, in one embodiment the nozzle assembly 22 includes a fluidic oscillator configured to control application of the first fluid F1 onto the strand 12 such that the first fluid F1 may be applied in a non-linear pattern. For example, the fluidic oscillator may discharge a second fluid F2 at opposite sides of the orifice 28, via first and second branches 174*a*, 174*b*, to cause the first fluid F1 to be applied in a non-linear pattern across a width or at least a portion of the outer circumference, of the strand 12.

Referring to FIGS. 3 and 4A-4H, in one example, the nozzle assembly 22 includes a first conduit 130 in which the first fluid F1 may flow. The fluidic oscillator of the nozzle assembly 22 may be formed by a second conduit 132 within the nozzle assembly 22, an oscillator conduit 134 in fluid communication with the second conduit 132, and an application conduit 136, fluidically connected to the first conduit 130 and second conduit 132.

The first conduit 130 is configured to a deliver the first fluid F1 to the application conduit 136. The first conduit 130 includes a first inlet 138 configured to receive the first fluid F1 from the first fluid supply module 18. It is understood that the inlet 138 may be formed in a side of plate of the nozzle assembly 22 facing toward the applicator, i.e., away from remaining plates of the nozzle assembly, such that the first fluid F1 may be received in the first conduit 130. For example, the first inlet 138 may be formed on a side of the first plate configured to abut the applicator head 16, or other adjacent component, from which the first fluid is discharged. In one embodiment, the first conduit 130 may be generally triangular in cross-section, with rounded corners. The first conduit 130 may also include a width and height. In one example, the width is greater than the height. However, it is understood that these configurations are described for purposes of example only, and the present disclosure is not limited thereto. For example, the first conduit may be formed in different suitable cross-sectional shapes and have varying relative dimensions of width and height.

The second conduit 132 is formed in the nozzle assembly 22 and is configured to deliver the second fluid F2 to the application conduit 136. The second conduit 132 includes a second inlet 140 configured to receive the second fluid F2 from the second fluid supply module 20. It is understood that the second inlet 140 may be formed in a plate of the nozzle assembly 22, for example, first plate 122*a*, so that the second fluid F2 is received in the second conduit 132 from the second inlet 140.

Figure 4A:
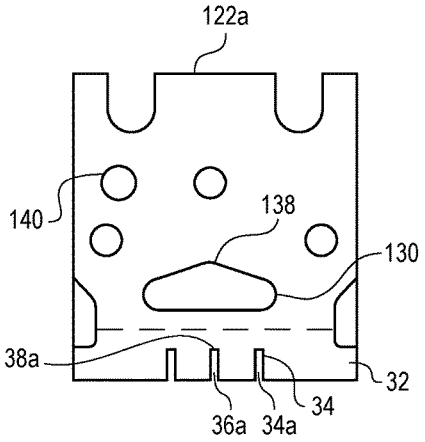
FIGS. 4A-4H are enlarged views of the nozzle components of FIG. 3.
Figure 4B:
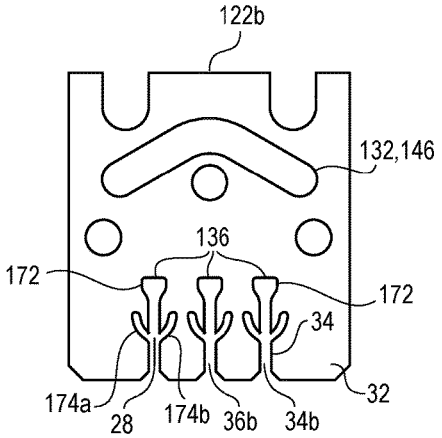
Figure 4C:
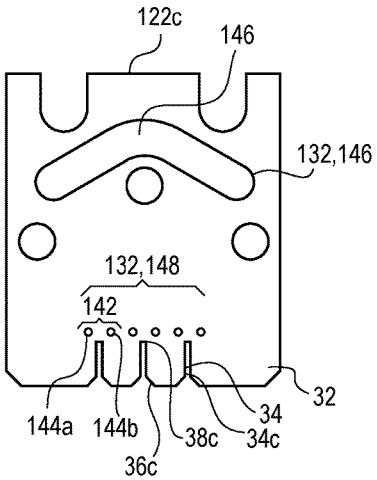

Referring to FIG. 3, and FIGS. 4A-4F, in one embodiment, the second conduit 132 may include one or more flow-splitting sections 142 (FIGS. 4C and 4D), as described further below, where the second conduit 132 may be split so as to deliver the second fluid F2 to first and second branches 174*a*, 174*b* of the application conduit 136. In one embodiment, the flow-splitting section 142 may include a first branch feed hole 144*a* and a second branch feed hole 144*b* (FIG. 4C). The first branch feed hole 144*a* and second branch feed hole 144*b* may be in direct fluid communication with the application conduit 136 so as to supply the second fluid F2 to the application conduit 136 (FIG. 4B).

With further reference to the examples in FIGS. 3 and 4A-4F, the second conduit 132 may include a first portion 146 (FIGS. 4B-4E), a second portion 148 (FIGS. 4C-4E) and a reservoir 150 (FIG. 4F) spacing apart and fluidically connecting the first portion 146 and the second portion 148. The first portion 146 extends between the second inlet 140 and the reservoir 150 generally in a first direction D1 (FIG. 5). In one embodiment, the first portion 146 may be formed as an elongated opening, having a generally inverted "v," or "u," shape in cross-section. However, other angled or curved elongated shapes, or non-angled or non-curved shapes that do not interfere with fastening openings 80 (described further below) may be suitable as well.

The second portion 148 extends between the reservoir 150 and the application conduit 136 generally in a second direction D2 (FIG. 5). In one embodiment, the first direction D1 and second direction D2 are generally opposite to one another. In one example, the reservoir 150 extends generally perpendicularly between the first portion 146 and the second portion 148, but is not limited to this configuration.

It is understood that the terminology "generally in a first direction D1" refers to the direction from the second inlet 140 to the reservoir 150, and may include variations in the direction as a result of the specific geometry and configuration of the first portion 146. Similarly, it is understood that the terminology "generally in a second direction D2" refers to the direction from the reservoir 150 to application conduit 136, and may include variations in the direction as a result of the specific geometry and configuration of the second portion 148.

The reservoir 150 is configured to receive the second fluid F2, flowing in the first direction D1, from the first portion 146 of the second conduit 132. In one non-limiting embodiment, for example, as shown in FIGS. 3 and 4F, the reservoir 150 may be formed substantially in a U-shape. The reservoir 150 may include first and second receiving legs 152*a*, 152*b* configured to receive the second fluid F2 from the first portion 146 of the second conduit 132. The reservoir 150 may further include a cross-leg 154 fluidically connected to the first and second receiving legs 152*a*, 152*b* and configured to receive the second fluid F2 from the first and second receiving legs 152*a*, 152*b*. In this example, the cross-leg 154 is fluidically connected to the second portion 148 of the second conduit 132 and is configured to deliver the second fluid F2 to the second portion 148 such that the second fluid F2 may flow in the second direction D2 to the application conduit 136. It is understood that various other shapes and configurations for the reservoir 150 are envisioned that allow for the second fluid F2 to flow from the first portion 146 to the second portion 148 of the second conduit 132.

The second portion 148 of the second conduit 132 may include one or more body feed holes 156 fluidically connected to the reservoir 150 and configured to receive the second fluid F2 from the reservoir 150. In the example shown in FIGS. 3 and 4E, the body feed hole 156 is configured to receive the second fluid F2 from the cross-leg 154 of the reservoir 150. The body feed hole 156 is fluidically connected to the flow-splitting section 142.

Figure 4D:
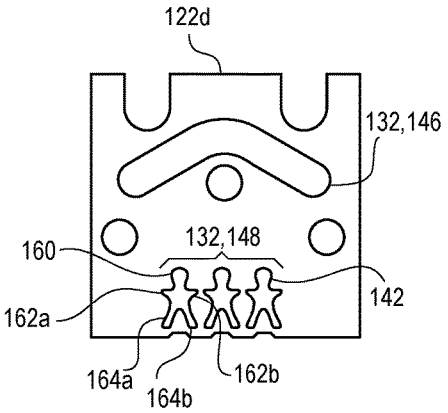
Figure 5:
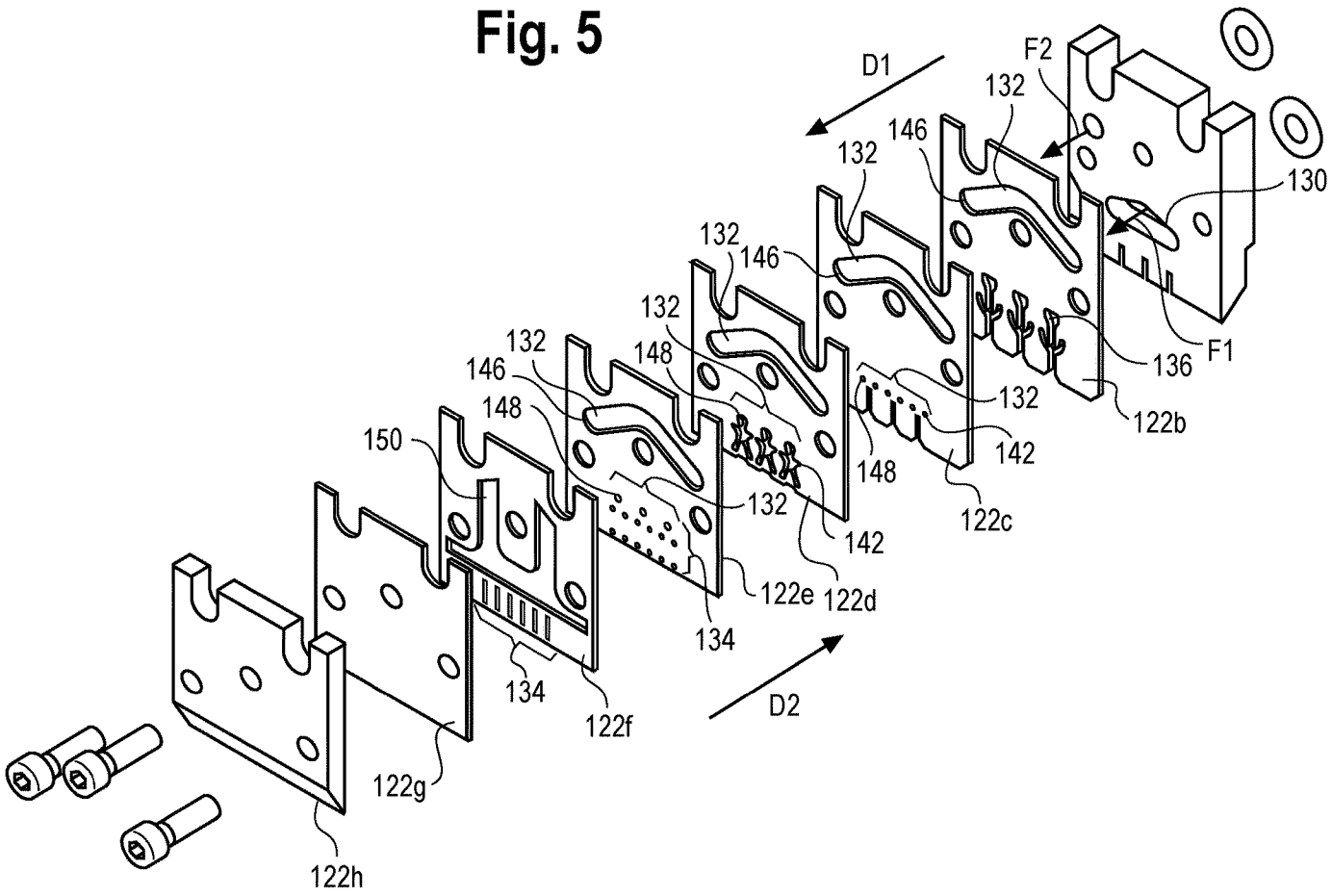
FIG. 5 is an exploded perspective view of the contact nozzle components of FIG. 3.

Referring to FIGS. 3 and 4D, in one embodiment, the flow-splitting section 142 may include a generally body-shaped portion. The body-shaped portion may include a head 160, first and second arms 162*a*, 162*b* and first and second legs 164*a*, 164*b*. The head 160 of the flow-splitting section 142 is fluidically connected to the body feed hole 156 and is configured to receive the second fluid F2 therefrom. The second fluid F2, received in the head 160 of the flow-splitting section 142 may then to the first and second arms 162*a*, 162*b* and first and second legs 164*a*, 164*b* of the flow-splitting section 142.

As noted above, the flow-splitting section 142 is configured to split the flow of the second fluid F2. Referring to the non-limiting example shown in FIGS. 3, 4C and 4D, the first leg 164*a* (FIG. 4D) of the flow-splitting section 142 may be aligned with and fluidically connected to the first branch feed hole 144*a* (FIG. 4C) and the second leg 164*b* (FIG. 4D) of the flow-splitting section 142 may be aligned with and fluidically connected to the second branch feed hole 144*b* (FIG. 4C). Accordingly, the first and second branch feed holes 144*a*, 144*b* may receive the second fluid F2 from the first and second legs 164*a*, 164*b*, respectively, of the flow-splitting section 142. The first and second branch feed holes 144*a*, 144*b* are fluidically connected to the application conduit 136 and are configured to deliver the second fluid F2 to the application conduit 136 as described further below.

Figure 4E:
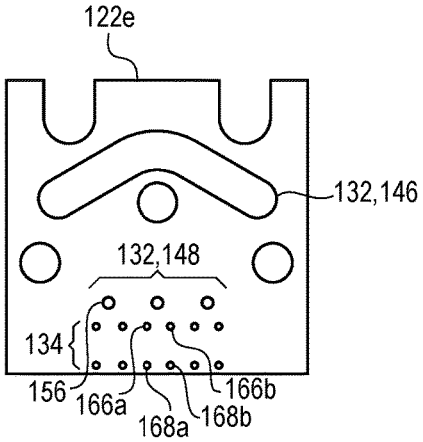
Figure 4F:
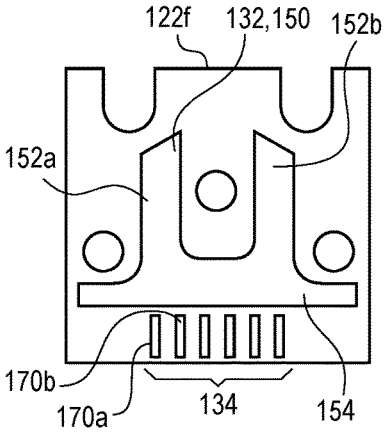

With reference to FIGS. 3, 4E and 4F, the oscillator conduit 134 may be formed in the nozzle assembly 22. In the example shown in FIG. 3, the oscillator conduit 134 is fluidically connected to the second conduit 132, for example, at the flow-splitting section 142 and is configured to vary a pressure of the second fluid F2 flowing through the flow-splitting section 142, in part, by creating or amplifying a turbulent flow in the second fluid F2.

In one embodiment, the oscillator conduit 134 includes one or more pairs of arm feed holes, each pair of arm feed holes including first and second arm feed holes 166*a*, 166*b* and one or more pairs of leg feed holes, each pair of leg feed holes including including first and second leg feed holes 168*a*, 168*b*. The first and second arm feed holes 166*a*, 166*b* are aligned with and fluidically connected to the first arm 162*a* and second arm 162*b*, respectively, of the flow-splitting section 142. Likewise, the first and second leg feed holes 168*a*, 168*b* are aligned with and fluidically connected to the first leg 164*a* and second leg 164*b*, respectively, of the flow-splitting section 142. The oscillator conduit 134 further includes one or more pairs of oscillator slots, each pair including first and second oscillator slots 170*a*, 170*b*. The first oscillator slot 170*a* is aligned with and fluidically connected to the first arm feed hole 166*a* and the first leg feed hole 168*a*. Likewise, the second oscillator slot 170*b* is aligned with and fluidically connected to the second arm feed hole 166*b* and the second leg feed hole 168*b*. Accordingly, the first oscillator slot 170*a* is configured to receive the second fluid F2 from the first leg feed hole 168*a* and discharge the second fluid F2 through the first arm feed hole 168*b*. Similarly, the second oscillator slot 170*b* is configured to receive the second fluid F2 from the second leg feed hole 168*b* and discharge the second fluid F2 through the second arm feed hole 166*b*.

Referring still to the example in FIG. 3, and with further reference to FIG. 4B, the application conduit 136 includes a receptacle 172, the first branch 174*a* and the second branch 174*b*. The receptacle 172 is fluidically connected to the first conduit 130, and thus, is configured to receive the first fluid F1 from the first conduit 130. The first branch 174*a* and the second branch 174*b* are aligned with and fluidically connected to the first branch feed hole 144*a* and second branch feed hole 144*b*, respectively. Accordingly, the first branch 174*a* and the second branch 174*b* are configured to receive the second fluid F2 from the first branch feed hole 144*a* and second branch feed hole 144*b*, respectively. The receptacle 172, the first branch 174*a* and the second branch 174*b* are fluidically connected to the orifice 28.

In the examples above, the second portion 148 of the second conduit 132, the oscillator conduit 134, and the application conduit 136 define a flow path for the second fluid F2 between the reservoir 150 and the orifice 28. It is understood that multiple flow paths may be provided in the nozzle assembly 22 to control the application of the first fluid F1 onto additional strands of material 12. For example, as shown in FIGS. 3 and 4A-4F, the fluidic oscillator includes three flow-splitting sections 142, each flow-splitting section 142 having a body-shaped portion, first branch feed hole 144*a* and second branch feed hole 142*b*, and three body feed holes 156, formed in the second portion 148 of the second conduit 132. Similarly, the oscillator conduit 134 may include three pairs of arm feed holes 166*a*, 166*b*, three pairs of leg feed holes 168*a*, 168*b* and three pairs of oscillator slots 170*a*, 170*b*. Further, the nozzle assembly, as shown in FIG. 4B, for example, may include three application conduits 136. Accordingly, the first fluid F1 may be applied on three strands via three respective application conduits 136. In this example, the first conduit 130 may be fluidically connected to each application conduit 136, and thus, may supply the first fluid F1 to respective receptacles of the application conduits 136. In addition, the first portion 146 of the of the second conduit 132 may supply the second fluid F2 to the reservoir 150, and in turn, to the second portion 148 of the second conduit 132, the oscillator conduits 134 and the application conduits 136.

It is understood that the configurations shown in FIGS. 3 and 4A-4F are non-limiting, and that the number of flow-splitting sections 142, including the body-shaped portions, first branch feed holes 144*a*, and second branch feed holes 144*b*, body feed holes 156, arm feed hole pairs 166*a*, 166*b*, leg feed hole pairs 168*a*, 168*b*, oscillator slot pairs 170*a*, 170*b*, and application conduits 136 may vary depending on the number of strands of material 12 the nozzle assembly 22 is configured to accommodate. The nozzle assembly 22 may be configured to accommodate, for example, anywhere from one strand to ten strands, but is not limited to this range.

As noted above, and with further reference to FIGS. 3 and 4A-4H, the nozzle assembly 22 may be formed by a plurality of laminated or stacked plates. In one embodiment, the nozzle assembly 22 is formed by eight plates 122*a-h*. The first conduit 130, second conduit 132, oscillator conduit 134 and application conduit 136 may be formed in and configured to extend in one or more plates. In a non-limiting example, and with reference to FIG. 4A, the first conduit 130 may be formed in the first plate 122*a*. The first inlet 136 may be formed at a side of the first plate 122*a* facing an adjacent component, such as the adapter 24. The first conduit 130 may be formed through a thickness of the first plate 122*a*.

The second inlet 140 may be formed in the first plate 122*a* as well. The second conduit 132, as shown in FIGS. 4A-4F, may extend through the thickness of the first plate 122*a*, the second plate 122*b*, the third plate 122*c*, the fourth plate 122*d*, the fifth plate 122*e* and the sixth plate 122*f*. In one embodiment, the first portion 146 of the second conduit 132 extends through the second plate 122*b*, the third plate 122*c*, the fourth plate 122*d* and the fifth plate 122*e*. As described above, the first portion 146 may be formed as an elongated, angled or curved opening in the second through fifth plates 122*b-e*. These elongated openings may be similarly positioned on the plates 122*b-e* so that they are substantially aligned when the nozzle assembly 22 is assembled and secured to the adapter 24.

Referring to FIGS. 3 and 4F, the reservoir 150 may be formed in the sixth plate 122*f*. Referring to FIGS. 4C-4E, the second portion 148 of the second conduit 132 may be formed in the third plate 122*c*, fourth plate 122*d* and fifth plate 122*e*. For example, the body feed hole 156 may be formed in the fifth plate 122*e*, the flow-splitting section 142 may be formed in the fourth plate 122*d* and the first and second branch feed holes 144*a*, 144*b* may be formed in the third plate 122*c*.

Referring to FIGS. 4E and 4F, the oscillator conduit 134 may be formed in the fifth plate 122*e* and sixth plate 122*f*. For example, the first and second arm feed holes 166*a*, 166*b* and the first and second leg feed holes 168*a*, 168*b* may be formed in the fifth plate 122*e*. The first and second oscillator slots 170*a*, 170*b* may be formed in the sixth plate 122*f*.

With reference to FIG. 4B, the application conduit 136, including the receptacle 172, first branch 174*a* and the second branch 174*b* may be formed in the second plate 122*b*. The orifice 28 may be formed in the second plate 122*b* as well. The at least one guide slot 34 may be formed in the first, second and third plates 122*a-c* as described below and shown in FIGS. 4A-C.

In one embodiment, the depending guide section 32 is formed on first plate 122*a*, second plate 122*b* and third plate 122*c* (FIGS. 4A-4C). The guide slots 34 are formed on the depending guide section 32 on the first, second and third plates 122*a*, 122*b*, 122*c* as well. Each guide slot 34 may include a first guide slot segment 34*a* formed on the first plate 122*a*, a second guide slot segment 34*b* formed on the second plate 122*b*, and a third guide slot segment 34*c* formed on the on the third plate 122*c*.

The first guide slot segment 34*a* includes an open end 36*a* and a closed end 38*a*. The closed end 38*a* may include a curved surface configured to substantially match a profile of the strand 12 and act as a stop for the strand 12 to properly position the strand 12 relative to the orifice 28. The second guide slot segment 34*b* includes an open end 36*b*. The open end 36*b* may include a substantially inverted v-shaped portion as described above. The second guide slot segment 34*b* is in communication with the orifice 28 at an end opposite to the open end 36*b*. The third guide slot segment 34*c* includes an open end 36*c* and a closed end 38*c*. The open end 36*c* may include a substantially inverted v-shaped portion as described above. The closed end 38*c* of the third guide slot segment 34*c* may include a substantially square or rectangular portion having a width greater than the width of an adjacent portion of the guide slot segment 34*c*.

In one embodiment, the nozzle assembly 22 includes three guide slots 34, each guide slot 34 including first, second and third guide slot segments 34*a-c*. However, it is understood the number of guide slots 34 may vary to accommodate different number of strands 12. The number of guide slots 34 may correspond to the number of application conduits 136. When assembled, the first guide slot segment 34*a*, second guide slot segment 34*b* and third guide slot segment 34*c* are substantially aligned to form the guide slot 34. The strand 12 may be received through the respective open ends 36*a*, 36*b*, 36*c*, i.e., the open end 36 of the guide slot 34, and moved to the closed end 38 of the guide slot 34. The closed end 38 of the guide slot 34 is defined by the first closed end 38*a* and third closed end 38*c*. The orifice 28 is formed in the second plate 122*b* immediately adjacent to and between the closed ends 38*a*, 38*c*.

Figure 4G:
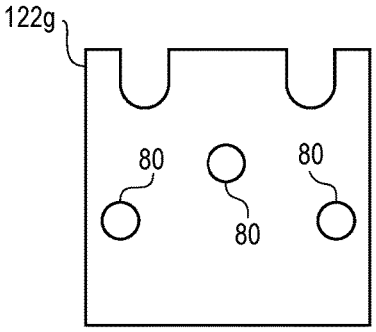
Figure 4H:
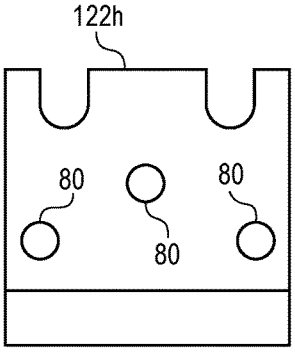

Referring to FIGS. 4G and 4H, the seventh plate 122*g* and eighth plate 122*h* are positioned at an opposite end of the nozzle assembly 22 from the first plate 122*a*. In one embodiment, the seventh plate 122*g* acts as a seal that forms a boundary for the second conduit 132. That is, the seventh plate 122*g* is configured to seal the second conduit 132 at the reservoir 150 and oscillator slots 170*a*, 170*b*. The eighth plate 122*h* is an end plate for increasing the structural integrity of the nozzle assembly 22. The eighth plate 122*h* may include a beveled edge.

At least one fastening hole 80 may be formed in each of the plates 122*a-h*. In one embodiment, three fastening holes 80 are formed in each plate 122*a-h*. However, it is understood that the present disclosure is not limited to this configuration and the number of fastening holes 80 may vary. The fastening holes 80 of the plates 122*a-h* are aligned with one another so as to receive a fastener 82 (FIGS. 1 and 2) through each series of aligned fastening holes 80. The fastener 82 is configured to tightly fasten the plates 122*a-h* together so that leakage of the first fluid F1 and/or second fluid F2 between individual plates 122*a-h* is limited or prevented.

FIG. 5 is an exploded perspective view of the nozzle assembly 22 according to an embodiment described herein. Referring to FIGS. 2, 4A-4H, and 5, in one example of the nozzle assembly 22, the first inlet 138 is configured to receive the first fluid F1 from the first fluid supply module 18. The first conduit 130 is configured to receive the first fluid F1, via the first inlet 138 and supply the first fluid F1 to the application conduit 136. In one embodiment, the receptacle 172 of the application conduit 136 receives the first fluid F1, and is configured to supply the first fluid F1 to the orifice 28 for application onto the stand of material 12. In one embodiment, the nozzle assembly 22 includes three application conduits 136 to apply the first fluid on three respective strands 12. However, as detailed above, the present disclosure is not limited to this configuration and the number of application conduits 136 may vary depending on a number of strands 12 it is desired for the nozzle assembly 22 to accommodate. Further, each of application conduits 136 may be fed from a single, common, first conduit 130.

The nozzle assembly 22 is configured to receive the second fluid F2 through the second inlet 140. The second conduit 132 is configured to receive the second fluid F2 from the second inlet 140 and feed the second fluid F2 through the nozzle assembly 22 to the application conduit 136. In one example, the first portion 146 of the second conduit 132 receives the second fluid F2 from the second inlet 140 and supplies the second fluid F2 to the reservoir 150. The reservoir 150 is configured to receive the second fluid F2 from the first portion 146 and discharge the second fluid F2 to the second portion 148 of the second conduit 132.

In one embodiment, each body feed hole 156 may receive the second fluid F2 from the reservoir 150. Each body feed hole 156 supplies the second fluid F2 to a respective flow-splitting section 142. The second fluid F2 may be received at a respective head 160 of each flow-splitting section 142 from the corresponding body feed hole 156. The second fluid F2 may flow through each flow-splitting section 142 from the head 160 to the first and second legs 164*a*, 164*b*. The first and second branch feed holes 144*a*, 144*b* are configured to receive the second fluid F2 from respective first and second legs 164*a*, 164*b* for each flow-splitting section 142. Accordingly, the first and second branch feed holes 144*a*, 144*b* may supply the second fluid F2 to corresponding first and second branches 174*a*, 174*b* of a respective application conduit 136.

A turbulent flow of the second fluid F2 in the second portion 148 of the second channel may result in the second fluid F2 being received at the first and second legs 164*a*, 164*b* from the head 160 at the flow-splitting section 142 at different pressures. In one embodiment, a portion of the fluid at the higher pressure flows into the oscillator conduit 134, while fluid at the lower pressure flows to a corresponding branch supply feed hole 144*a* or 144*b*.

For example, the second fluid F2 may be initially received at the first leg 164*a* at a higher pressure, and at the second leg 164*b* at a lower pressure relative to the first leg 164*a*. The second fluid F2 received in the first leg 164*a*, at the higher pressure, may be at least partially discharged to the first leg feed hole 168*a* of the oscillator conduit 134 and then into the first oscillator slot 170*a*. The second fluid F2 may then flow through the first oscillator slot 170*a* and be discharged from the first oscillator slot 170*a* through the first arm feed hole 166*a* of the oscillator conduit 134. This portion of second fluid F2 may then be received in the first arm 162*a* of the flow-splitting section 142. Another portion of the higher pressure second fluid F2 initially received in the first leg

164*a* is discharged to the first branch feed hole 144*a*, and in turn, to the first branch 174*a* of the application conduit 136.

Meanwhile, the second fluid F2 initially received in the second leg 164*b*, at the lower pressure, may be discharged from the second leg 164*b* to the second branch feed hole 144*b*. The second fluid F2 may flow though the second branch feed hole 144*b* and into the second branch 174*b* of the application conduit 136.

The second fluid F2 received at the first arm 162*a* from the oscillator conduit 134, at a higher pressure, may then flow into the second leg 164*b* of the flow-splitting section 142 due to the initial lower pressure of the second fluid in the second leg 164*b*. This causes the second leg 164*b* to become the leg having the second fluid F2 at the higher pressure, while the first leg 164*a* becomes the leg having the second fluid F2 at the lower pressure. That is, the first and second legs 164*a*, 164*b* alternate between receiving the second fluid at a higher pressure and a lower pressure by way of the oscillator conduit 134.

With the second leg 164*b* containing the second fluid F2 at a higher pressure than the second fluid F2 in the first leg 164*b*, a portion of the second fluid F2 may be discharged to the second leg feed hole 168*b* of the oscillator conduit 134 and then into the second oscillator slot 170*b*. The second fluid F2 may then flow through the second oscillator slot 170*b* and be discharged through the second arm feed hole 166*b* of the oscillator conduit 134. This portion of second fluid F2 may then be received in the second arm 162*b* of the flow-splitting section 142. Another portion of the higher pressure second fluid F2 received in the second leg 164*b* is discharged to the second branch feed hole 144*b*, and in turn, to the second branch 174*b* of the application conduit 136.

Meanwhile, the second fluid F2 in the first leg 164*a*, now at the lower pressure, may be discharged from the first leg 164*a* to the first branch feed hole 144*a*. The second fluid F2 may flow though the first branch feed hole 144*a* and into the first branch 174*a* of the application conduit 136.

Accordingly, the second fluid F2 may be supplied to the first and second branch feed holes 144*a*, 144*b* at alternating higher and lower relative pressures, and in turn, to the first branch 174*a* and second branch 174*b* at alternating higher and lower relative pressures. The varying pressures of the second fluid F2 supplied to the first and second branches 174*a*, 174*b* cause the second fluid F2 to be discharged to the orifice 28 at different pressures, thereby causing the first fluid F1 to be fluctuated back and forth across a width of the strand 12. In one embodiment, this configuration causes a lateral fluctuation in first fluid F1 as it is applied onto the strand 12, such that the first fluid F1 is applied in an irregular, non-predetermined, and/or non-repeatable pattern.

In the examples shown in FIGS. 1-5, and as described above, the first fluid F1 may be an adhesive, such as a hot melt adhesive that is gathered in the receptacle 172 of the application conduit 136 and is forced through the orifice 28 for direct application on the strand 12, which is positioned at the orifice 28. The first and second branches 174*a*, 174*b* may be positioned on opposite sides of the orifice 28. The second fluid F2 may be, for example, air, and may be discharged from the first branch 174*a* and second branch 174*b* at varying pressures causing the first fluid F1 to fluctuate across a width of the strand 12 during application.

Accordingly, in the examples above, a contact nozzle assembly may be provided that applies an adhesive directly to a strand of material in a non-linear pattern. Thus, the fluid application device 10 may be operated at increased line speeds associated with contact nozzle configurations, while still providing a non-linear pattern of adhesive applied onto the strand. A non-linear adhesive pattern may allow for the strand or strands 12 to be bonded to the substrate 14 over a larger rotational range of the strands 12 compared to a linear application pattern. That is, with a linear adhesive pattern, the strand or strands 12 must be accurately positioned relative to the substrate so that the linearly applied adhesive contacts the substrate. With the non-linear pattern, the strand or strands 12 may be rotated, intentionally or unintentionally due to movement of the strand through the device 10, and still provide a sufficient bonding surface between the strand 12 and the substrate 14. In addition, the non-linear pattern may allow the strand or strands 12 to be bonded to the substrate 14 at points or segments, rather than in a continuous line. This configuration may provide added flexibility, as the strand or strands 12 are allowed to freely stretch and contract along portions between the bonded segments.

Figure 6:
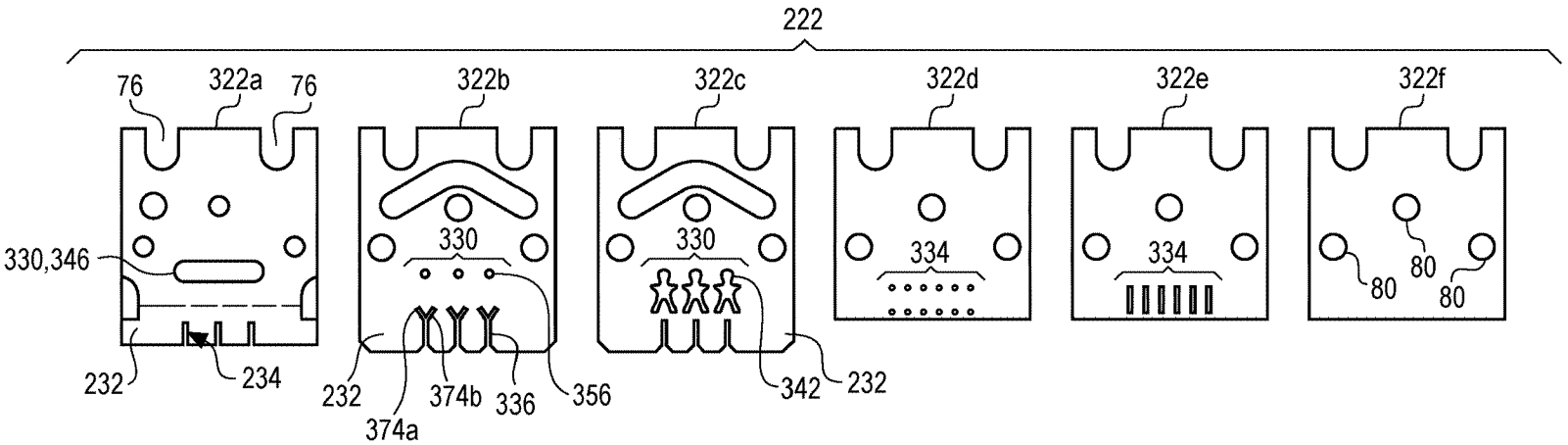
FIG. 6 is a plan view of the contact nozzle components according to another embodiment described herein.

FIG. 6 is a front view of the components of a nozzle assembly 222 according to another embodiment of the present disclosure. FIGS. 7A-7F are enlarged plan views of the components of the nozzle assembly 222 of FIG. 6. Referring to the embodiment in FIGS. 6 and 7A-7F, the first fluid F1 may be applied to a strand 12 of material from opposed first and second branches 374*a*, 374*b* of one or more application conduits 336 at varying pressures. Accordingly, the first fluid F1 may be fluctuated across a width of the strand 12 during application onto the strand 12. In this embodiment, a second fluid F2 is not used to control application of the first fluid F2 on the strand 12. Rather, the first fluid F1 is discharged from opposing branches 374*a*, 374*b* and is fluctuated as result of varying discharge pressures.

Referring to FIGS. 6 and 7A-7F, the first conduit 330 may include a first inlet (not shown) at a side of the nozzle assembly 222 facing the adjacent component, such as the adapter 24. The first conduit 330 is configured to receive the first fluid F1 from the first fluid supply module 18 via the first inlet (not shown). In one embodiment, the first conduit 330 includes a first portion 346 that is generally elongated in a width direction. The first conduit 330 may further include one or more body feed holes 356 (FIG. 7B) aligned with and fluidically connected to first portion 346.

Figure 7A:
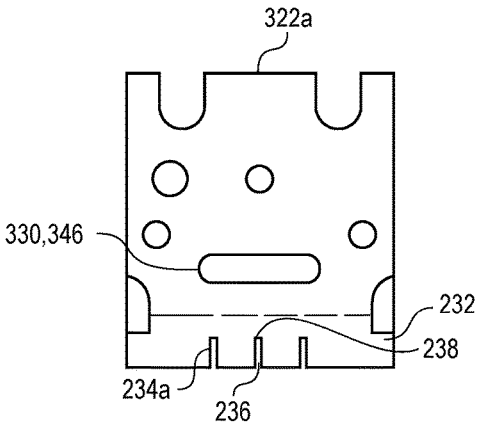
FIGS. 7A-7F are enlarged views of the nozzle components of FIG. 6.
Figure 7B:
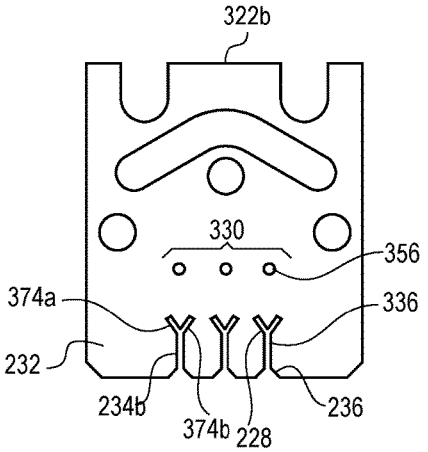
Figure 7C:
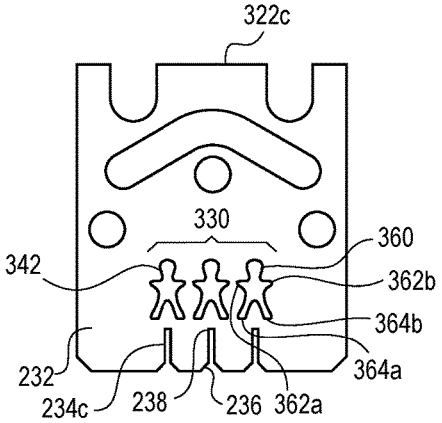

Referring to FIGS. 6 and 7C, the first conduit 330 further includes at least one flow-splitting section 342. In one embodiment, the flow-splitting section 342 may be formed as a generally body-shaped portion having a head 360, first and second arms 362*a*, 362*b* and first and second legs 364*a*, 364*b*.

Referring to FIGS. 6 and 7B, the application conduit 336 includes the first branch 374*a* and the second branch 374*b* as noted above. In one embodiment, the first and second branches 374*a*, 374*b* are angled relative to one another so as to form a substantially V-shaped cross-section. The first and second branches 374*a*, 374*b* are in fluid communication with and converge at the orifice 228, where the first fluid F1 may be applied to the strand 12. The first branch 374*a* and second branch 374*b* are fluidically connected to the first leg 364*a* and the second leg 364*b*, respectively, of the flow-splitting section 342. Accordingly, the first branch 374*a* may receive the first fluid F1 from the first leg 364*a* and the second branch 374*b* may receive the first fluid F1 from the second leg 364*b*. In the example shown in FIGS. 6 and 7B, three application conduits 336 are provided. However, it is understood that the present disclosure is not limited to the configuration, and the number of application conduits 336 may vary to accommodate a different number of strands 12.

Figure 7D:
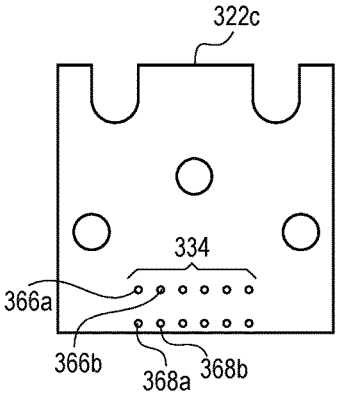
Figure 7E:
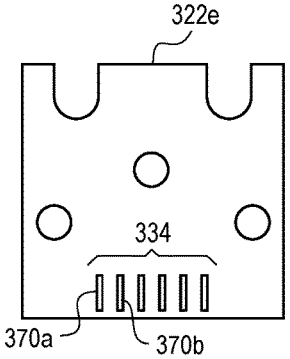

With reference to FIGS. 6, 7D and 7E, the nozzle assembly 222 further includes an oscillator conduit 334. The oscillator conduit 334 is fluidically connected to the first conduit 330 at the flow-splitting section 342 and is configured to vary a pressure of the first fluid F1 flowing through the flow-splitting section 342, in part, by creating or amplifying a turbulent flow in the first fluid F1.

In one embodiment, the oscillator conduit 334 includes one or more pairs of arm feed holes, each pair of arm feed holes including first and second arm feed holes 366*a*, 366*b* and one or more pairs of leg feed holes, each pair of leg feed holes including first and second leg feed holes 368*a*, 368*b*. The first and second arm feed holes 366*a*, 366*b* are aligned with and fluidically connected to the first arm 362*a* and second arm 362*b*, respectively, of the flow-splitting section 342. Likewise, the first and second leg feed holes 368*a*, 368*b* are aligned with and fluidically connected to the first leg 364*a* and the second leg 364*b*, respectively, of the flow-splitting section 342. The oscillator conduit 334 further includes one or more pairs of oscillator slots, each pair of oscillator slots including first and second oscillator slots 370*a*, 370*b*. The first oscillator slot 370*a* is aligned with and fluidically connected to the first arm feed hole 366*a* and first leg feed hole 368*a*. Likewise, the second oscillator slot 370*b* is aligned with and fluidically connected to the second arm feed hole 366*b* and the second leg feed hole 368*b*. Accordingly, the first oscillator slot 370*a* is configured to receive the first fluid F1 from the first leg feed hole 368*a* and discharge the first fluid F1 through the first arm feed hole 366*a*. Similarly, the second oscillator slot 370*b* is configured to receive the first fluid F1 from the second leg feed hole 368*b* and discharge the first fluid F1 through the second arm feed hole 366*b*.

In one embodiment, the first fluid F1 may be received in the first portion 346 of the first conduit 330 via the first inlet (not shown). The body feed hole 356 is configured to receive the first fluid F1 from the first portion 346 of the first conduit 330. In one embodiment, there may be three body feed holes 356 configured to receive the first fluid F1 from the first portion 346. However, it is understood that the number of body feed holes 356 may vary and is not limited to this example. The number of body feed holes 356 may correspond to the number of application conduits 336 and the number of strands of material 12 that may be accommodated by the nozzle assembly 222. In addition, those having ordinary skill in the art will appreciate that additional arm feed hole pairs 366*a*, 366*b* and leg feed hole pairs 368*a*, 368*b*, along with additional oscillator slot pairs 370*a*, 370*b* may be provided at the oscillator conduit 334 to correspond to additional flow-splitting sections 342.

The head 360 of the flow-splitting section 342 is in fluid communication with the body hole 356 and is configured to receive the first fluid F1 from the body feed hole 356. The first fluid F1 may flow from the head 360 to the first and second legs 364*a*, 364*b*. The first and second branches 374*a*, 374*b* of the application conduit 336 are configured to receive the first fluid F1 from the respective first and second legs 364*a*, 364*b* of the flow-splitting section 342. In one embodiment, the first conduit 330 may include three flow-splitting sections 342. It is understood, however, that this example is non-limiting, and that the number of flow-splitting sections 342 may vary. The number of flow-splitting sections 342 may correspond to the number of body feed holes 356, such that each body feed hole 356 is in fluid communication with a head 360 of a respective flow-splitting section 342.

A turbulent flow of the first fluid F1 in the first conduit 330 may be received at the first and second legs 364*a*, 364*b* from the head 360 at the flow-splitting section 342 at different pressures. In one embodiment, at least a portion of the fluid at the higher pressure flows into the oscillator conduit 334, while fluid at the lower pressure flows to a corresponding first branch 374*a* or to a second branch 374*b* of the application conduit 336.

For example, the first fluid F1 may be initially received in the first leg 364*a* at a higher pressure, and in the second leg 364*b* at a lower pressure relative to the first leg 364*a*. The first fluid F1 received in the first leg 364*a*, at the higher pressure, may be at least partially discharged to the first leg feed hole 368*a* of the oscillator conduit 334 and then into the first oscillator slot 370*a*. The first fluid F1 may then flow through the first oscillator slot 370*a* and be discharged through the first arm feed hole 366*a* of the oscillator conduit 334. This portion of first fluid F1 may then be received in the first arm 362*a* of the flow-splitting section 342. Another portion of the higher pressure first fluid F1 initially received in the first leg 364*a* is discharged to the first branch 374*a* of the application conduit 336.

Meanwhile, the first fluid F1 initially received in the second leg 364*b*, at the lower pressure, may be discharged from the second leg 364*b* and received in the second branch 374*b* of the application conduit 336.

The first fluid F1 received at the first arm 362*a* from the oscillator conduit 334, at a higher pressure, may then flow into the second leg 364*b* of the flow-splitting section 342 due to the initial lower pressure of the first fluid F1 in the second leg 364*b*. This causes the second leg 364*b* to become the leg having the first fluid F1 at the higher pressure, while the first leg 364*a* becomes the leg having the first fluid F1 at the lower pressure. That is, the first and second legs 364*a*, 364*b* alternate between receiving the first fluid F1 at a higher pressure and a lower pressure by way of the oscillator conduit 334.

With the second leg 364*b* containing the first fluid F1 at a higher pressure than the first fluid F1 in the first leg 364*a*, a portion of the first fluid F1 may be discharged to the second leg feed hole 368*b* of the oscillator conduit 334 and then into the second oscillator slot 370*b*. The first fluid F1 may then flow through the second oscillator slot 370*b* and be discharged through the second arm feed hole 366*b* of the oscillator conduit 334. This portion of first fluid F1 may then be received in the second arm 362*b* of the flow-splitting section 342. Another portion of the higher pressure first fluid F1 received in the second leg 364*b* is discharged to the second branch 374*b* of the application conduit 336.

Meanwhile, the first fluid F1 in the first leg 364*a*, now at the lower pressure, may be discharged from the first leg 364*a* to the first branch 374*a* of the application conduit 336.

Accordingly, the first fluid F1 may be supplied to the first branch 374*a* and the second branch 374*b* at alternating higher and lower relative pressures. The varying pressures of the first fluid F1 supplied to the first and second branches 374*a*, 374*b* causes the first fluid F1 to be discharged to the orifice 228 at different pressures, thereby causing the first fluid F1 to be fluctuated back and forth across a width of the strand 12. In one embodiment, this configuration causes a lateral fluctuation in first fluid F1 as it is applied onto the strand 12, such that the first fluid F1 is applied in an irregular, non-predetermined, and/or non-repeatable pattern.

With further reference to FIGS. 6 and 7A-7C, the nozzle assembly 222 may include a depending guide section 232 having guide slots 234 similar to the guide slots 34 described in the embodiments above. For example, the nozzle assembly 222 may include three guide slots 234, each configured to receive a strand of material 12. Each guide slot 234 may include an open end 236 and a closed end 238. The closed end 238 may act as a stop to position the strand 12 relative to the orifice 28. The open end 236 of each guide slot 234 may include a portion shaped generally as an inverted "v" to assist in guiding the strand 12 into the guide slot 234.

The nozzle assembly 222 may also include securing openings 76 and fastening holes 80 as described in the embodiments above and shown in FIGS. 1-5. In the examples shown in FIGS. 6 and 7A-7F, the nozzle assembly 22 may include two securing openings 76 and three fastening holes 80. However, it is understood that these examples are non-limiting and different configurations are envisioned. The securing openings 76 are configured to receive securing elements 74, and the fastening holes 80 are configured to receive fasteners 82.

The nozzle assembly 222 may be formed from a plurality of laminated or stacked plates 322*a-f* secured together by the fasteners 82, and in some embodiments, at least in part by the securing elements 74 as well. The securing openings 76 and fastening holes 80 may extend through each plate. Referring to FIGS. 6 and 7A-7F, the nozzle assembly 222 may be formed by six plates, including a first plate 322*a*, a second plate 322*b*, a third plate 322*c*, a fourth plate 322*d*, a fifth plate 322*e* and a sixth plate 322*f*. It is understood that a different number of plates may be implemented in the nozzle assembly 222 so long as the general concepts described above are preserved.

Referring to FIG. 7A, in one embodiment, the first plate 322*a* may include the first portion 346 of the first conduit 330, securing openings 76 and fastening holes 80. Similar to the guide slots 34 described in the embodiments above, each guide slot 234 may be formed by, for example, a first guide slot segment 234*a*, a second guide slot segment 234*b* (FIG. 7B) and a third guide slot segment 234*c* (FIG. 7C) formed in adjacent plates and aligned so as to receive the strand of material. The first guide slot segments 234*a* may be formed in the first plate 322*a*.

Referring to FIG. 7B, the second plate 322*b* may include body feed holes 356, application conduits 336, securing openings 76 and fastening holes 80. The second plate 322*b* may also include second guide slot segments 34*b* and orifices 28.

Referring to FIG. 7C, the third plate 322*c* may include flow-splitting sections 342, third guide slot segments 34*c*, securing openings 76 and fastening holes 80. The orifices 28 may be defined in the second plate 322*b* between the first plate 322*a* and third plate 322*c*. The depending guide section 232 may be formed on the first plate 322*a*, second plate 322*b* and third plate 322*c*. Referring to FIGS. 6 and 7A-7C, the aligned first, second and third guide slot segments 234*a-c* my form a single guide slot 234, and three guide slots 234 may be formed across a width of the nozzle assembly 222. Additionally, the third plate 322*c* may include three flow-splitting sections 342. However, it is understood that the number of guide slots 234 and flow-splitting sections is not limited thereto.

Referring to FIG. 7D, the fourth plate 322*d* may include the first and second arm feed holes 366*a*, 366*b* and the first and second leg feed holes 368*a*, 368*b* of the oscillator conduit 334. The fourth plate 322*d* may also include securing openings 76 and fastening holes 80. In one embodiment, the fourth plate 322*d* may include three pairs of first and second arm feed holes 366*a*, 366*b*, and three pairs of first and second leg feed holes 368*a*, 368*b*. However, the present disclosure is not limited thereto.

Referring to FIG. 7E, the fifth plate 322*e* may include first and second oscillator slots 370*a*, 370*b* of the oscillator conduit 334. In addition, the fifth plate 322*e* may include securing openings 76 and fastening holes 80. In one embodiment, the fifth plate 322*e* may include three pairs of first and second oscillator slots 370*a*, 370*b*, but the present disclosure is not limited thereto.

Figure 7F:
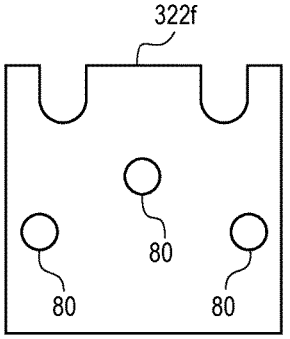

With reference to FIG. 7F, the sixth plate 322*f* may include securing openings 76 and fastening holes 80. The sixth plate 322*f* may seal the oscillator conduit 334 at the first and second oscillator slots 370*a*, 370*b*.

In the examples above, the first fluid F1 may be directly, i.e., contactingly, applied on a strand or strands 12 in a non-linear pattern. Accordingly, the fluid application device 10 may be operated at increased line speeds when compared to non-contact nozzle configurations, while still providing a benefits of a non-linear application pattern detailed above.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A fluid application device for applying a fluid to a strand of material in a contact-type application in a non-linear manner, the device comprising:

an applicator head; and a nozzle assembly fluidically coupled to the applicator head, the nozzle assembly comprising:

a first conduit configured to receive a first fluid from the applicator head;

an application conduit including a first branch and a second branch fluidically connected with the first conduit and configured to receive the first fluid from the first conduit;

an orifice downstream from and fluidically connected to the application conduit, the orifice configured to receive the first fluid from the first branch and the second branch and discharge the first fluid for application onto a strand of material; and a guide slot extending from the orifice, the guide slot configured to receive the strand of material, wherein the first branch and the second branch extend in converging directions relative to one another in a direction toward the orifice such that discharge of the first fluid from the first branch and the second branch causes the first fluid to fluctuate during application onto the strand of material.

2. The fluid application device of claim 1, the first conduit further comprising a flow-splitting section including a first leg fluidically connected to the first branch and a second leg fluidically connected to the second branch.

3. The fluid application device of claim 2, the flow-splitting section further comprising a head configured to receive the first fluid, a first arm and a second arm, and the nozzle assembly further comprising an oscillator conduit, the oscillator conduit comprising a first arm feed hole fluidically connected to the first arm, a second arm feed hole fluidically connected to the second arm, a first leg feed hole fluidically connected to the first leg, a second leg feed hole fluidically connected to the second leg, a first oscillator slot fluidically connected to the first arm feed hole and the first leg feed hole, and a second oscillator slot fluidically connected to the second arm feed hole and the second leg feed hole.

4. A nozzle assembly for a fluid application device, the nozzle assembly comprising:

a first conduit configured to receive a first fluid;

an application conduit including a first branch and a second branch fluidically connected with the first conduit and configured to receive the first fluid;

an orifice downstream from and fluidically connected to the application conduit, the orifice configured to receive the first fluid from the first branch and the second branch and discharge the first fluid for application onto a strand of material; and a guide slot extending from the orifice, the guide slot configured to receive the strand of material, wherein the first branch and the second branch extend in converging directions relative to one another in a direction toward the orifice such that discharge of the first fluid from the first branch and the second branch causes the first fluid to fluctuate during application onto the strand of material.

5. The nozzle assembly of claim 4, the first conduit further comprising a flow-splitting section including a first leg fluidically connected to the first branch and a second leg fluidically connected to the second branch.

6. The nozzle assembly of claim 5, the flow-splitting section further comprising a head configured to receive the first fluid, a first arm and a second arm, and the nozzle assembly further comprising an oscillator conduit, the oscillator conduit comprising a first arm feed hole fluidically connected to the first arm, a second arm feed hole fluidically connected to the second arm, a first leg feed hole fluidically connected to the first leg, a second leg feed hole fluidically connected to the second leg, a first oscillator slot fluidically connected to the first arm feed hole and the first leg feed hole, and a second oscillator slot fluidically connected to the second arm feed hole and the second leg feed hole.

7. The nozzle assembly of claim 4, further comprising a plurality of laminated plates, wherein the first conduit, application conduit, orifice and guide slot are formed in one or more plates of the plurality of laminated plates.

* * * * *